US005199644A

United States Patent [19]

Haferkorn

[11] Patent Number: 5,199,644

[45] Date of Patent: Apr. 6, 1993

[54] HVLP PAINT SPRAY GUN

[75] Inventor: Wolfgang Haferkorn, Frankfurt am Main, Fed. Rep. of Germany

[73] Assignee: Bersch & Fratscher GmbH, Karlstein am Main, Fed. Rep. of Germany

[21] Appl. No.: 588,176

[22] Filed: Sep. 26, 1990

[30] Foreign Application Priority Data

Oct. 6, 1989 [DE] Fed. Rep. of Germany ... 8911932[U]

[51] Int. Cl.[5] ..... B05B 1/28; B05B 1/34

[52] U.S. Cl. ..... 239/296; 239/DIG. 14; 239/290; 239/424

[58] Field of Search ..... 239/290, 291, 296, 300, 239/423, 424, DIG. 14, 292

[56] References Cited

U.S. PATENT DOCUMENTS

| | | | |
|---|---|---|---|
| 1,950,779 | 3/1934 | Bramsen | 239/300 |
| 2,708,095 | 5/1955 | Mitchell | 239/300 |
| 2,743,963 | 5/1956 | Peeps | 239/300 |
| 3,087,682 | 4/1963 | Peeps | 239/424 |
| 4,911,365 | 3/1990 | Thiel et al. | 239/296 |
| 4,915,303 | 4/1990 | Hufgard | 239/300 |

FOREIGN PATENT DOCUMENTS

| | | | |
|---|---|---|---|
| 736131 | 8/1955 | United Kingdom | 239/296 |

*Primary Examiner*—Andres Kashnikow
*Assistant Examiner*—Christopher G. Trainor
*Attorney, Agent, or Firm*—Trexler, Bushnell, Giangiorgi & Blackstone, Ltd.

[57] ABSTRACT

A spray gun including a gun body having an air inlet channel, an air expansion chamber and an air distribution chamber. The air inlet channel and the air expansion chamber are interconnected by an orifice for achieving sonic velocities and reducing the pressure of the air. The air expansion chamber and air distribution chamber are interconnected by a distribution disc which allows the air to flow from the air expansion chamber into the air distribution chamber for distribution out of an air outlet nozzle at low pressure for atomizing paint.

8 Claims, 1 Drawing Sheet

HVLP PAINT SPRAY GUN

BACKGROUND OF THE INVENTION

This invention relates to a paint spray gun producing less overspray and therefore providing a cleaner environment.

Every conventional paint spray gun working with compressed air atomizes the paint by the velocity difference of the air leaving the air nozzle and the paint leaving the paint nozzle. Depending upon the air volume, air velocity, expansion, and flow conditions, small, medium and large droplets of paint develop.

Due to the high expansion ratio of the air changing the atmospheric pressure from 15 psi to 100 psi outside of the air nozzle the paint droplets will be atomized. This also results in a fog of paint that will not reach the object to be painted. This overspray contaminates the environment.

It is desirable to form the smallest paint droplets in order to obtain the best finish of the painted surface. The conventional guns working with pressures from 15 psi to 100 psi generally show good atomization, resulting in high overspray since the air is entering the air nozzle at high pressure and expands outside of the air cap.

The low pressure guns already in use work with much lower pressures and corresponding large volume of air. Since the large air volume is flowing through the gun, large air passages are necessary. Due to the low air velocity at the nozzle, resulting from low air pressures, atomization of the paint, in many cases, is not fine enough. This happens particularly with materials of high viscosity or low thinner content.

An object of the present invention is to provide a new paint spray gun to disperse the paint into sufficiently small droplets without forming overspray. As a result, both paint consumption and environmental contamination will be reduced.

A more specific object of the present invention is to provide a new paint spray gun which has a mass flow rate equal to conventional guns but with a larger volume flow.

SUMMARY OF THE INVENTION

A paint spray gun including a gun body having means for receiving liquid and means for directing the liquid through a paint chamber and out of the gun body through a liquid outlet nozzle, and means for receiving air at an air pressure entrance level and means for directing the air through the gun body and out at least one air outlet nozzle at a relatively low air pressure, the air directing means including a flat stream inlet channel having a predetermined cross-section for directing a flat stream air flow through the gun body and a round stream inlet channel having a predetermined cross-section for directing a round stream air flow through said gun body, separate expansion chambers respectively associated with each of the inlet channels and separate orifices connecting the inlet channels and the expansion chambers and having a reduced cross-section for reducing the pressure of the air from the channels and directing the air into the air expansion chambers, separate air distribution chambers respectively associated with each of the air expansion chambers and a distribution disc having a plurality of apertures separately connecting the expansion chambers and the distribution chambers, the air distribution chambers directing the air out of the gun through separate air outlet nozzles for atomizing the liquid leaving the gun body through the liquid outlet nozzle.

DESCRIPTION OF THE PREFERRED EMBODIMENT

Figure 1:
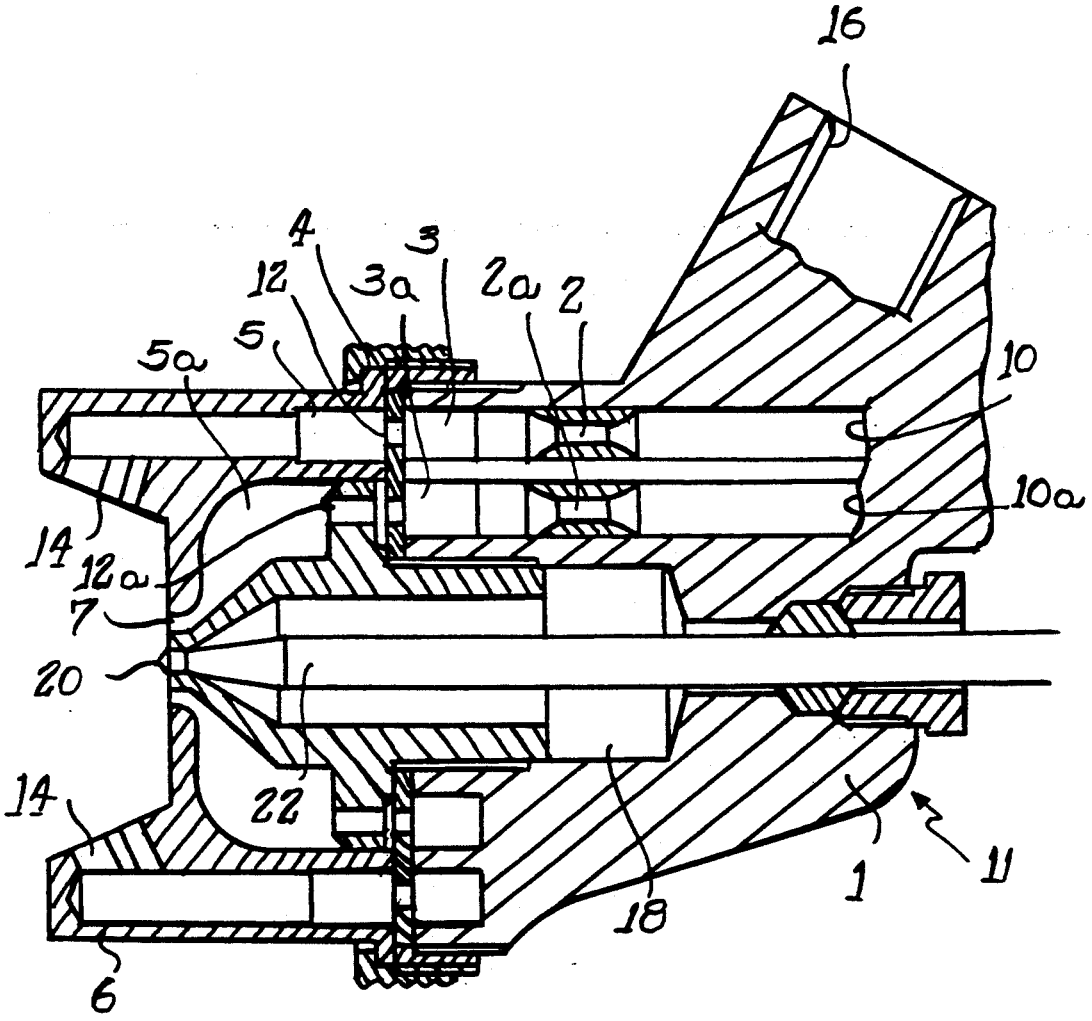
FIG. 1 is a longitudinal sectional view of the spray gun constructed in accordance with the present invention.

As shown in FIG. 1, the gun 11 includes a gun body 1 which has a paint or liquid entry inlet chamber 16. The paint inlet chamber 16 is connected to a paint reservoir or container (not shown) by conventional means. The paint entry inlet chamber 16 is interconnected to a paint chamber 18 as shown in FIG. 1. The paint chamber 18 includes a needle valve 22 which is operated in a known manner to allow paint or liquid to flow from the paint chamber 18 through a paint outlet nozzle 20.

The gun body 1 also includes a first spray stream air inlet channel or chamber 10 and a second spray stream air inlet channel or chamber 10*a* for receiving air from an air supply source (not shown). The air channels 10 and 10*a* are interconnected to the air supply source or reservoir in a known manner. The air traveling through first air inlet chamber 10 exits the gun body 1 through a pair of side air nozzles 14 as described in detail below. The air traveling through second air inlet channel 10*a* exits the gun body 1 through air nozzle 7 in the manner described below. Each of the air inlet channels 10 and 10*a* has a predetermined cross section. The air inlet channels 10 or 10*a* receive air at pressures from approximately 15 psi to 100 psi from the air supply source in a known manner. First and second air channels 10 and 10*a* include first and second members or orifices 2 and 2*a* respectively. The air is supplied to the gun body 1 by conventional means at pressures from 15 psi to 100 psi, and flows through the flat stream channel 10 or the round stream channel 10*a* reaching orifices or members 2 or 2*a* respectively. Orifices 2 and 2*a* include converging and diverging air flow entrance and exit configurations for reducing the cross-section of air channels 10 or 10*a* by approximately 15% to 50%. The air pressure is reduced at the outlet of orifices 2 or 2*a* with respect to the supply pressure. For example, the pressure may be reduced to approximately 15 psi. Due to the pressure reduction by the orifices 2 and 2*a* to a value below 48% of the entrance pressure, the air stream reaches sonic velocity and a substantially constant volumetric flow rate. This well-known venturi effect maintains constant expansion chamber entrance pressure when supply pressure is in the normal range of 15 psi to 100 psi.

Downstream from orifice 2 and 2*a* the air partially expands as it enters an air expansion chamber 3 or 3*a* at about 7 psi to 15 psi, depending on the supply pressures, which chambers are designed to receive a large volume of air. Air expansion chambers 3 and 3*a* are ring-type chambers which have a cross section approximately 5 to 10 times greater than the cross section of orifices 2 and 2*a*.

The gun body 1 also includes ring-type chambers or air distribution chambers 5 and 5*a*. A distribution disc 4 having apertures 12 and 12*a* interconnect chambers 5 or 5*a* to chambers 3 or 3*a* respectively. Chambers 5 and 5*a* have a cross section larger than the cross section of chambers 3 and 3*a*.

Apertures 12 and 12a are arranged in circles of different diameters and are provided with a number of small bores or slots for receiving the air stream flowing from air inlet chamber 10 or air inlet chamber 10a.

The air passes through the air expansion chambers 3 or 3a through the distribution aperture 12 or 12a and passes into the air distribution chambers 5 or 5a where the remaining turbulent air flow changes almost totally into laminar flow.

The air stream traveling through first air inlet channel 10 and into chamber 5 through the side air nozzle orifices 14 and interacts with the paint shooting out of paint outlet nozzle to produce a substantial flat stream of paint. The air stream traveling through second air inlet channel 10a and into chamber 5a exits the gun body 1 through air nozzle orifice 7 and interacts with paint exiting from paint outlet nozzle 20 to produce a substantially round stream of paint. The air pressure is reduced to about 4 psi to 9 psi in the chambers 5 and 5a before it enters nozzle orifices 14 or 7 and exits with a velocity ranging from 435 ft/sec. to 870 ft/sec. Since there is very little air expansion when the air exits the gun body from nozzle 7 or 14 there will be less fog or overspray, the paint consumption will be reduced and the gun will operate with less noise.

I claim:

1. A paint spray gun comprising a gun body having means for receiving liquid and means for directing said liquid through a paint chamber and out of said gun body through a liquid outlet nozzle, and means for receiving air at an air pressure entrance level and means for directing said air through said gun body and out at least one air outlet nozzle at a relatively low air pressure, said air directing means including a first stream inlet channel having a predetermined cross-section for directing said air through said gun body and a second stream inlet channel having a predetermined cross-section for directing said air through said gun body, separate expansion chambers respectively associated with each of said inlet channels, separate orifices connecting said inlet channels and said expansion chambers, said orifices having a reduced cross-section for reducing the pressure of said air from said channels into said air expansion chambers, separate air distribution chambers respectively associated with each of said air expansion chambers a distribution disc having a plurality of apertures separately connecting said expansion chambers and said distribution chambers, said air distribution chambers directing said air out of said gun through separate air outlet nozzles, wherein said separate air outlet nozzles atomize and shape said liquid leaving said gun body through said liquid outlet nozzle.

2. A paint spray gun of claim 1 wherein said air expansion chambers have a cross-section greater than the cross-section of said air inlet channels and said air distribution chambers have a cross-section greater than said cross-section of said air expansion chambers.

3. A paint spray gun comprising a gun body having means for receiving liquid and means for directing said liquid through said gun body and out a liquid outlet nozzle and air receiving means and means for directing said air through said gun body out at least one air outlet nozzle, said air receiving means including at least one air inlet channel having a predetermined cross-section, each of said at least one air inlet channels having means for reducing the air pressure and directing said air into a respective air expansion chamber having a predetermined cross-section, said air expansion chamber being interconnected to a respective air distribution chamber having a predetermined cross-section by a distribution disc having at least one aperture for directing air from said respective air expansion chamber to said respective air distribution chamber, said air distribution chamber distributing said air out of said gun body through a respective air outlet nozzle for atomizing said liquid exiting said gun body through said liquid outlet nozzle.

4. A spray gun of claim 3 wherein said air directing means includes a first air inlet channel and a second air inlet channel, said air being directed through said first air inlet channel exits said gun body through a said respective air outlet nozzle atomizing said liquid exiting from said liquid outlet nozzle and producing a substantially flat liquid stream, and said air being directed through said second air inlet channel exits said gun body through a said respective air outlet nozzle atomizing said liquid exiting from said liquid outlet nozzle and producing a substantially round liquid stream.

5. A paint spray gun including a gun body having means for receiving liquid and retaining said liquid in said gun body and means for receiving pressurized air at a predetermined range of air entrance pressures, said gun body comprising: means for directing said liquid out of said gun body through a liquid outlet nozzle and means for directing said air through said gun body and out at least one air outlet nozzle at substantially constant air flow rates, said air directing means including at least one air inlet channel having a predetermined cross-section for initially receiving said air, said air inlet channel merging into an air expansion chamber having a predetermined cross-section larger than said cross-section of said air inlet channel, said air expansion chamber being connected to an air distribution chamber for distributing said air out of said gun body through said air outlet nozzle, said air distribution chamber having a predetermined cross-section larger than said cross-section of said air expansion chamber, said air inlet channel and said air expansion chamber being interconnected by means for reducing said entrance air pressure, said air expansion chamber being interconnected with said air distribution chamber by a distribution disc.

6. A spray gun of claim 5 wherein said air directing means includes a first inlet channel and a second inlet channel for directing air through said gun, said air being directed through said first inlet channel exits said gun body through one of said at least one air outlet nozzles atomizing said liquid exiting from said liquid outlet nozzle and producing a substantially flat liquid stream and said air directed through said second inlet channel exits through another of said at least one air outlet nozzles atomizing said liquid exiting from said liquid out nozzle and producing a substantially round liquid stream.

7. A spray gun of claim 5 wherein said air pressure reduction means includes an orifice having a cross-section sufficiently less than the cross-section of said air inlet channel to cause sonic flow.

8. A spray gun of claim 7 wherein said air pressure reduction means includes an orifice having converging and diverging entrance and exit configurations reducing the air inlet channel cross-section from 15% to 50%.

* * * * *